United States Patent [19]

Oemcke et al.

[11] Patent Number: 5,006,875

[45] Date of Patent: Apr. 9, 1991

[54] FILM PROCESSOR WITH ABSORBENT ROLLER TO ELIMINATE WATER SPOTTING

[75] Inventors: Kenneth W. Oemcke; Evan P. Carmichael, both of Rochester, N.Y.

[73] Assignee: Eastman Kodak Company, Rochester, N.Y.

[21] Appl. No.: 535,627

[22] Filed: Jun. 11, 1990

[51] Int. Cl.[5] ..... G03D 3/13

[52] U.S. Cl. ..... 354/299; 354/322; 15/100

[58] Field of Search ..... 354/318, 319, 320, 321, 354/322, 299; 15/100, 102

[56] References Cited

U.S. PATENT DOCUMENTS

| | | | |
|---|---|---|---|
| 1,623,528 | 4/1927 | Moos | 15/100 |
| 3,422,479 | 1/1969 | Jeffee | 15/100 |
| 4,063,324 | 12/1977 | Junge | 15/100 |
| 4,737,810 | 4/1988 | Kobayashi et al. | 354/299 |
| 4,745,423 | 5/1988 | Uchida | 354/320 |
| 4,853,727 | 8/1989 | Ganzke et al. | 354/319 |
| 4,875,067 | 10/1989 | Kanzaki et al. | 354/325 |

*Primary Examiner*—A. A. Mathews

*Attorney, Agent, or Firm*—G. Herman Childress

[57] ABSTRACT

A processor for sheets of x-ray film has racks of rollers for transporting the film sheets sequentially through a series of stations including a washing station and a drying station. A pair of squeegee rollers located where the film leaves the washing station and enters the drying station squeezes most of the wash liquid from the sheet of film. However, a bead of water may remain on the tail end of the film as it leaves the squeegee rollers, and this bead of water can be deposited onto rollers in the drying station and then be deposited onto the next sheet of film to form water spots on the film after it is dried. In order to greatly reduced these water spots, an absorbent roller is located between the squeegee rollers and the rollers in the drying station so that after the film leaves the squeegee rollers it contacts the abosrbent roller which removes the bead of water from the tail end of the film.

3 Claims, 1 Drawing Sheet

FILM PROCESSOR WITH ABSORBENT ROLLER TO ELIMINATE WATER SPOTTING

BACKGROUND OF THE INVENTION

The present invention relates to a film processor and, more particularly, to a processor for sheets of x-ray films wherein water spots previously visible on processed sheets are substantially eliminated.

Known processors for photographic film sheets transport the film sequentially through a series of stations where latent images on the film are developed by a developing solution, then the developed image is fixed by a fixing solution, the sheet is washed to remove residual solutions on the film and subsequently dried. It is known to use rollers to remove at least a portion of the various solutions between stations in a processor. For example, in U.S. Pat. No. 4,737,810 a guide roller removes at least some of the developer from film as it travels between two developing areas in a processor. Also, U.S. Pat. No. 4,853,727 discloses a roller which is biased against the film as it is moved between two wash sections in a film processor. This roller removes a layer of washing agent present in one wash solution before the film enters a second wash solution. The processing apparatus disclosed in U.S. Pat. No. 4,875,067 has a rotating brush which contacts a surface of the film after it is sprayed with a developer.

The various rollers of the referenced patents as described above contact a surface of the film as it travels along its normal film path. These patents also disclose various squeegee rollers along the path of movement of the film for driving the film along its path and for separating adjacent processing solutions from one another by squeezing the solutions from the surfaces of the film as it moves through the squeegee rollers.

When a sheet of film passes through squeegee rollers, a bead of liquid may cling to the trailing edge of the film after it leaves the rollers. If the squeegee rollers are at the exit of the final wash station in the processor, a bead of water on the tail end of the film entering the drying station can be deposited onto the beginning roller in the dryer rack of the dryer station. This bead of water will travel with the surface of the roller and be deposited onto the surface of the next sheet of film entering the dryer rack. As this bead of water is dried in the drying station water spots are formed on the sheet of film which are viewable by the customer. Such spots are undesirable, not only because of their appearance but because they may obscure the image on the developed sheet of film.

SUMMARY OF THE INVENTION

Accordingly, an object of the invention is to greatly reduce or eliminate water spots formed on a sheet of film in the manner explained herein before. The present invention is useful in a film processor wherein squeegee rollers are located where the film leaves the washing station and enters the drying station, and wherein the rollers in the drying station define a curved path for the film after it leaves the squeegee rollers so that the trailing end of the film is deflected out of the normal film path when the leading end of the film enters the curved path and the trailing end leaves the squeegee rollers. In accordance with the present invention, an absorbent roller is provided in the drying station and located outside the normal film path between the squeegee rollers and the transport rollers in the drying station. The absorbent roller is positioned with respect to the normal path for film so that the absorbent roller is contacted by the trailing end portion of the film when the trailing end leaves the squeegee roller and is deflected out of the normal film path.

The invention, and its object and advantages, will become more apparent in the detailed description of the preferred embodiment of the invention presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
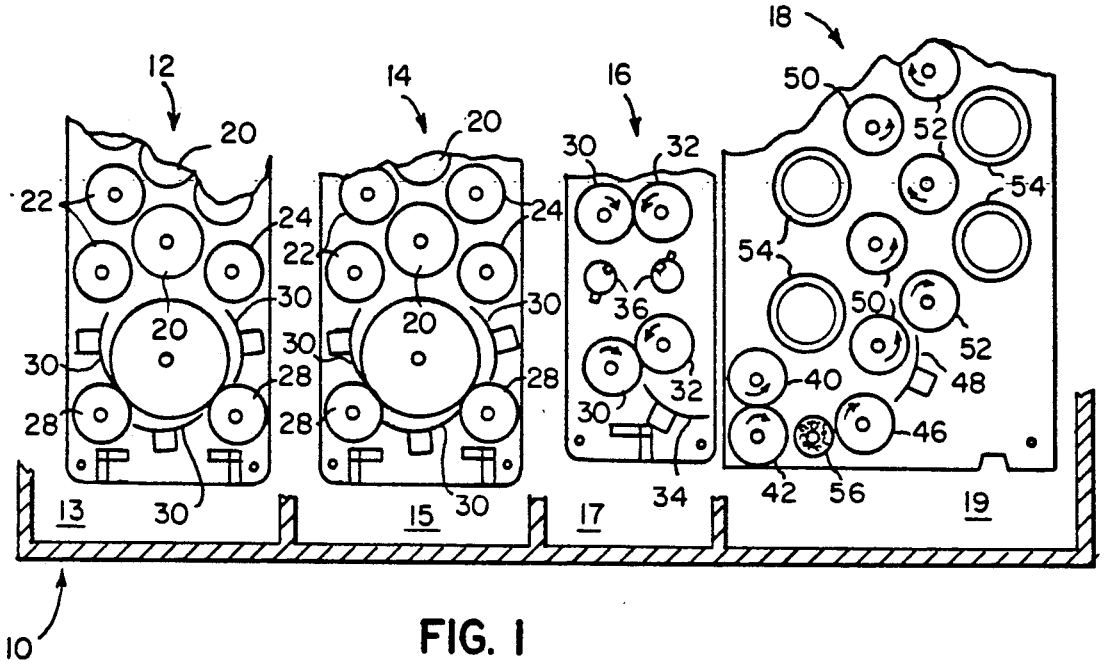
FIG. 1 is a fragmentary elevation view showing the relationship of several racks of rollers in stations of a sheet film processor in accordance with the present invention.

Referring now to FIG. 1 of the drawings, a processor for sheets of film, such as x-ray film, is generally designated 10 and comprises racks 12, 14, 16 and 18 of rollers for transporting film sheets sequentially through a developing station 13, a fixing station 15, a washing station 17 and a drying station 19, respectively. Roller rack 12 comprises vertical rows of center rollers 20 and side rollers 22, 24. Rollers 20 are rotated counterclockwise and rollers 22, 24 are rotated clockwise so that a sheet of film can be fed downwardly in the rack between the rollers 20, 22 and upwardly in the rack between the rollers 20 and 24. At the bottom of the rack a turnaround roller 26 and associated nip rollers 28 together with guide shoes 30 cause a sheet of film leaving the path defined by rollers 20, 22 to be inverted and guided into the path for the film defined by rollers 20, 24. At the top of rack 12 the sheet is deflected into the rack 14 by deflection members, not shown. Rack 14 is similar in construction and operation to the rack 12 and thus need not be described in detail.

Roller rack 16 for the wash station comprises a plurality of pairs of rollers 30, 32 which define a nip. The film passes through the nip of the rollers and is driven downwardly through the roller rack by these rollers until the film sheet reaches the bottom of the rack where a shoe 34 deflects the sheet from the wash rack into the dryer rack 18. As the sheet travels through the wash rack it is sprayed with water by nozzles 36 to clean processing solutions from the sheet.

Figure 2:
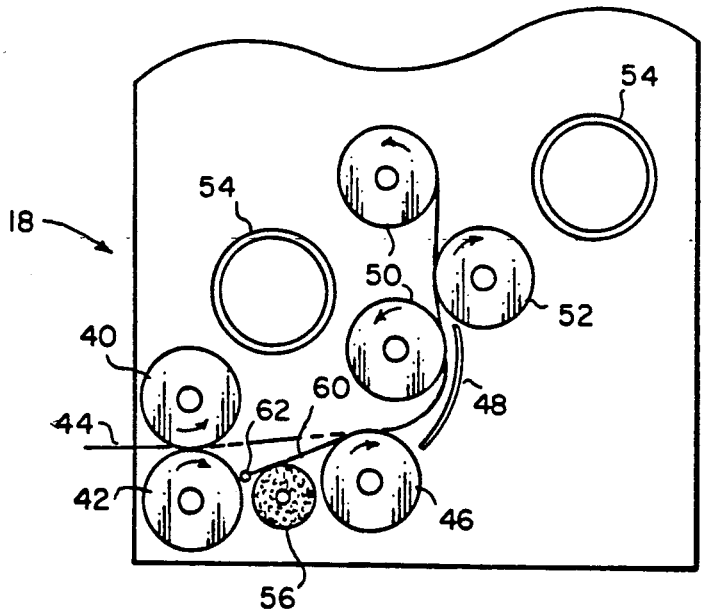
FIG. 2 is an enlarged fragmentary elevation view showing a portion of the rollers in the drying station.

Referring now to FIGS. 1 and 2, a pair or squeegee rollers 40, 42 are located along a film path 44 at the point where the film leaves the washing station 17 and enters the drying station 19. The shoe 34 deflects the film into the nip between squeegee rollers 40, 42, and the rollers 40, 42 are effective to drive the film in a generally horizontal plane as it enters the drying station. The squeegee rollers force most of the wash water from the surfaces of the film to facilitate drying of the film in station 18.

The drying station 19 comprises a first transport roller 46 which is driven in a clockwise direction to urge a sheet of film to the right, as viewed in the drawings, and into engagement with a curved shoe 48. The portion of the film path between the rollers 40, 42 and the shoe 48 is substantially horizontal. The shoe deflects the film upwardly into a second portion of the film path, which is located in a generally vertical plane. The drying station has a series of vertically-spaced rollers 50 located along one side of the film path 44 and another series of vertically-spaced transport rollers 52 located along the other side of the film path 44. Rollers 50 are rotated in a counterclockwise direction, as viewed in the drawings, and rollers 52 are rotated in a clockwise direction. Each of the rollers 52 are not only spaced from each other, but are also positioned generally between two adjacent rollers 50 so that the film travels along a sinuous shaped path as it moves upwardly from shoe 48. The leading end of the film is engaged and driven by rollers 50, 52 before the trailing end leaves the nip defined by rollers 40, 42. Air tubes 54 circulate warm air through the drying station to facilitate drying of the film.

In accordance with the present invention, an absorbent roller 56 is provided in the drying station 18. Roller 56 is located outside the normal film path between squeegee rollers 40, 42 and transport rollers 46, 50 and 52 in the drying station. More specifically, absorbent roller 56 is located beneath the first portion of the film path 44 between squeegee roller 42 and transport roller 46 with the uppermost portion of roller 56 being just below the first portion of the film path 44.

Due to the location of the absorbent roller 56 relative to squeegee rollers 40, 42 and transport roller 46, a sheet of film entering the drying station travels along path 44 above the absorbent roller 56 and then is directed upwardly by shoe 48 between the sets of transport rollers 50, 52. Because a sheet of film has a tendency to lie in a flat plane, this bending of the sheet of film as it travels between the horizontal and vertical portions of the film path causes the trailing end portion of the film, shown at 60 in FIG. 2, to snap downwardly into engagement with the surface of roller 56 when the trailing end leaves the nip between squeegee rollers 40, 42. As pointed out above, when the film leaves squeegee rollers 40, 42 it may have a bead of water on its trailing end, as shown at 62 in FIG. 2. As the film continues to be driven to the right and upwardly as viewed in FIG. 2, the bead of water wipes across the absorbent roller 56 and is removed from the end of the film by the absorbent roller. In the absence of the absorbent roller, the bead of water is deposited on roller 46, or one of the other transport rollers, and when the next sheet of film enters the drying station the bead of water can be deposited on that sheet of film to cause a defect known as water spots. Because the bead of film is removed by the absorbent roller 56, water spots are greatly reduced or eliminated.

By locating the absorbent roller below the normal film path 44 between rollers 40, 42 and roller 46, water absorbed by roller 56 is not deposited on subsequent sheets as the travel along the horizontal portion of path 44. Also, roller 56 is rotated slightly in response to engagement by the tail end of the film so the roller presents a new, dry portion of the roller to the next sheet of film. In addition, warm air circulated through the drying station by tubes 54 will heat the absorbent material and remove water deposited onto the absorbent roller, thus driving the roller.

Roller 56 can be made entirely of an absorbent material or, if desired, the roller can comprise a solid inner body portion covered with a suitable absorbent material.

The invention has been described in detail with particular reference to a preferred embodiment thereof, but it will be understood that variations and modifications can be effected within the spirit and scope of the invention.

We claim:

1. In a processor for sheets of film, the processor having racks of rollers for transporting the film sequentially through stations for developing the film, fixing the film, washing the film and drying the film, the rollers including a pair of squeegee rollers located where the film leaves the washing station for driving the film into the drying station, and the transport rollers in the drying station being spaced from the squeegee rollers and defining a path for the film leaving the squeegee rollers, the film path including a first portion adjacent the squeegee rollers and a second portion downstream from the first portion, the second portion being positioned at an angle with respect to the first portion so that the trailing end of the film is deflected out of the first portion of the film path when the leading end of the film enters the second portion of the path and the trailing end leaves the squeegee rollers, the improvement comprising:

an absorbent roller in the drying station located outside the first portion of the film path between the squeegee rollers and transport rollers in the drying station so that the absorbent roller is not contacted by the film as the film is driven along the first portion of the film path by the squeegee rollers, the absorbent roller being positioned with respect to the first portion of the path so that it is contacted by the trailing end of the film when the trailing end leaves the squeegee rollers and is deflected out of the first portion of the film path, whereby a bead of liquid on the trailing end of the film can be removed by the absorbent roller.

2. In a processor as set forth in claim 1 wherein the absorbent roller is between one of the squeegee rollers and the first transport roller in the drying station.

3. In a processor as set forth in claim 1 further comprising means for heating the absorbent roller to dry the roller.

* * * * *